US008434748B1

(12) United States Patent
Pearce et al.

(10) Patent No.: US 8,434,748 B1
(45) Date of Patent: May 7, 2013

(54) CUSHIONS COMPRISING GEL SPRINGS

(75) Inventors: Tony M. Pearce, Alpine, UT (US); Terry V. Pearce, Alpine, UT (US)

(73) Assignee: Edizone, LLC, Alpine, UT (US)

( * ) Notice: Subject to any disclaimer, the term of this patent is extended or adjusted under 35 U.S.C. 154(b) by 937 days.

(21) Appl. No.: 12/287,047

(22) Filed: Oct. 3, 2008

Related U.S. Application Data

(60) Provisional application No. 60/977,300, filed on Oct. 3, 2007, provisional application No. 60/004,460, filed on Nov. 27, 2007.

(51) Int. Cl.
*A47C 27/00* (2006.01)

(52) U.S. Cl.
USPC ..... 267/142; 5/655.5

(58) Field of Classification Search ..... 267/142–146, 267/152, 153; 248/634–638; 5/564, 655.5
See application file for complete search history.

(56) References Cited

U.S. PATENT DOCUMENTS

| | | | | |
|---|---|---|---|---|
| 1,228,783 | A | 6/1917 | Kerivan | |
| 2,029,370 | A | 2/1936 | Heldenbrand | |
| 2,385,870 | A * | 10/1945 | Lashar et al. | 428/370 |
| 2,458,588 | A | 1/1949 | Gordon et al. | |
| 2,491,557 | A | 12/1949 | Goolsbee | |
| 2,617,751 | A | 11/1952 | Bickett | |
| 2,655,369 | A | 10/1953 | Musilli | |
| 2,672,183 | A | 3/1954 | Forsyth | |
| 2,715,435 | A | 8/1955 | Rymland | |
| 2,814,053 | A | 11/1957 | Sevik | |
| 2,887,425 | A | 5/1959 | Holland | |
| 2,979,739 | A * | 4/1961 | Krakauer | 5/719 |
| 3,043,731 | A | 7/1962 | Hill | |
| 3,197,357 | A | 7/1965 | Schulpen | |
| 3,222,697 | A | 12/1965 | Scheermesser | |
| 3,308,491 | A | 3/1967 | Spence | |
| 3,407,406 | A | 10/1968 | Werner et al. | |
| 3,459,179 | A | 8/1969 | Olesen | |
| 3,462,778 | A | 8/1969 | Whitney | |
| 3,518,786 | A | 7/1970 | Holtvoigt | |
| 3,529,368 | A | 9/1970 | Canfield | |
| 3,552,044 | A | 1/1971 | Wiele | |
| 3,605,145 | A | 9/1971 | Graebe | |
| 3,748,669 | A | 7/1973 | Warner | |
| 3,748,779 | A | 7/1973 | Cherk et al. | |
| 3,801,420 | A | 4/1974 | Anderson | |
| 3,893,198 | A | 7/1975 | Blair | |
| 3,940,811 | A | 3/1976 | Tomikawa et al. | |
| 3,968,530 | A | 7/1976 | Dyson | |
| 3,986,213 | A | 10/1976 | Lynch | |
| 4,038,762 | A | 8/1977 | Swan, Jr. | |

(Continued)

FOREIGN PATENT DOCUMENTS

| | | |
|---|---|---|
| EP | 0614622 A1 | 9/1994 |
| GB | 1106958 | 3/1968 |

(Continued)

OTHER PUBLICATIONS

U.S. Appl. No. 61/039,259, filed Mar. 25, 2008, 26 pages.

(Continued)

*Primary Examiner* — Christopher Schwartz
(74) *Attorney, Agent, or Firm* — TraskBritt

(57) ABSTRACT

Various gel springs can be constructed for cushioning purposes.

27 Claims, 9 Drawing Sheets

U.S. PATENT DOCUMENTS 4,083,127 A 4/1978 Hanson
4,144,658 A 3/1979 Swan, Jr.
4,163,297 A 8/1979 Neumark
4,229,546 A 10/1980 Swan, Jr.
4,243,754 A 1/1981 Swan, Jr.
4,247,963 A 2/1981 Reddi
4,252,910 A 2/1981 Schaefer
4,255,202 A 3/1981 Swan, Jr.
4,256,304 A 3/1981 Smith et al.
4,274,169 A 6/1981 Standiford
4,279,044 A 7/1981 Douglas
4,292,701 A 10/1981 Woychick
4,335,476 A 6/1982 Watkin
4,335,478 A 6/1982 Pittman
4,369,284 A 1/1983 Chen
4,370,769 A 2/1983 Herzig et al.
4,378,396 A * 3/1983 Urai et al. ..... 428/198
4,383,342 A 5/1983 Forster
4,422,194 A 12/1983 Viesturs et al.
4,457,032 A * 7/1984 Clarke ..... 297/219.1
4,467,053 A 8/1984 Markle
4,472,847 A 9/1984 Gammons et al.
4,483,029 A 11/1984 Paul
4,485,505 A 12/1984 Paul
4,485,568 A 12/1984 Landi et al.
4,498,205 A 2/1985 Hino
4,541,136 A 9/1985 Graebe
4,572,174 A 2/1986 Eilender et al.
4,588,229 A 5/1986 Jay
4,614,632 A 9/1986 Kezuka et al.
4,618,213 A 10/1986 Chen
4,628,557 A 12/1986 Murphy
4,660,238 A 4/1987 Jay
4,670,925 A 6/1987 Carussi et al.
4,686,724 A 8/1987 Bedford
4,698,864 A 10/1987 Graebe
4,709,431 A 12/1987 Shaktman
4,713,854 A 12/1987 Graebe
4,726,624 A 2/1988 Jay
4,728,551 A 3/1988 Jay
4,737,998 A 4/1988 Johnson, Sr.
4,744,564 A 5/1988 Yamada
4,761,843 A 8/1988 Jay
4,842,330 A 6/1989 Jay
4,913,755 A 4/1990 Grim
4,945,588 A 8/1990 Cassidy et al.
4,952,190 A 8/1990 Tarnoff et al.
4,952,439 A 8/1990 Hanson
4,953,913 A 9/1990 Graebe
4,959,059 A 9/1990 Eilender et al.
4,967,433 A 11/1990 Neal
5,010,608 A 4/1991 Barnett et al.
5,015,313 A 5/1991 Drew et al.
5,018,790 A 5/1991 Jay
5,020,176 A 6/1991 Dotson
5,027,801 A 7/1991 Grim
5,039,567 A 8/1991 Landi et al.
5,052,068 A * 10/1991 Graebe ..... 5/654
5,053,436 A 10/1991 Delgado
5,058,291 A 10/1991 Hanson
5,074,620 A 12/1991 Jay et al.
5,079,786 A 1/1992 Rojas
5,079,787 A 1/1992 Pollmann
5,093,138 A 3/1992 Drew et al.
5,100,712 A 3/1992 Drew et al.
5,103,518 A 4/1992 Gilroy et al.
5,111,544 A * 5/1992 Graebe ..... 5/654
5,147,685 A 9/1992 Hanson
5,149,173 A 9/1992 Jay et al.
5,152,023 A 10/1992 Graebe
5,153,956 A 10/1992 Nold
5,163,196 A 11/1992 Graebe et al.
5,171,766 A 12/1992 Mariano et al.
5,172,494 A 12/1992 Davidson
5,180,619 A 1/1993 Landi et al.
5,190,504 A 3/1993 Scatterday
5,191,752 A 3/1993 Murphy
5,201,780 A 4/1993 Dinsmoor, III et al.
5,203,607 A 4/1993 Landi
5,204,154 A 4/1993 Drew et al.
5,211,446 A 5/1993 Jay et al.
5,243,722 A 9/1993 Gusakov
5,255,404 A 10/1993 Dinsmoor, III et al.
5,262,468 A 11/1993 Chen
5,282,286 A 2/1994 MacLeish
5,289,878 A 3/1994 Landi et al.
5,314,735 A 5/1994 Kronberg
5,330,249 A 7/1994 Weber et al.
5,334,646 A 8/1994 Chen
5,334,696 A 8/1994 Olson et al.
5,335,907 A 8/1994 Spector
5,336,708 A 8/1994 Chen
5,352,023 A 10/1994 Jay et al.
5,360,653 A 11/1994 Ackley
5,362,834 A 11/1994 Schapel et al.
5,369,828 A 12/1994 Graebe
5,403,642 A 4/1995 Landi et al.
5,421,874 A 6/1995 Pearce
5,429,852 A 7/1995 Quinn
5,444,881 A 8/1995 Landi et al.
5,445,861 A 8/1995 Newton et al.
5,452,488 A * 9/1995 Reinhardt ..... 5/729
5,456,072 A 10/1995 Stern
5,490,299 A 2/1996 Dinsmoor, III et al.
5,496,610 A 3/1996 Landi et al.
5,508,334 A 4/1996 Chen
5,513,402 A 5/1996 Schwartz
5,549,743 A 8/1996 Pearce
5,592,706 A 1/1997 Pearce
5,617,595 A 4/1997 Landi et al.
5,626,657 A 5/1997 Pearce
5,633,286 A 5/1997 Chen
5,636,395 A 6/1997 Serda
5,689,845 A 11/1997 Sobieralski et al.
5,749,111 A * 5/1998 Pearce ..... 5/652
5,881,409 A * 3/1999 Pearce ..... 5/702
5,994,450 A 11/1999 Pearce
6,026,527 A 2/2000 Pearce
6,115,861 A 9/2000 Reeder et al.
6,187,837 B1 2/2001 Pearce
6,241,695 B1 6/2001 Dabir
6,413,458 B1 7/2002 Pearce
6,490,744 B1 12/2002 Schulz, Jr.
6,498,198 B2 12/2002 Pearce
6,598,321 B2 7/2003 Crane et al.
6,704,961 B2 3/2004 Kienlein
6,797,765 B2 9/2004 Pearce
6,865,759 B2 3/2005 Pearce
6,905,831 B2 6/2005 Jiang et al.
6,908,662 B2 6/2005 Pearce
7,060,213 B2 6/2006 Pearce
7,076,822 B2 * 7/2006 Pearce ..... 5/655.5
7,138,079 B2 * 11/2006 Pearce ..... 264/50
7,444,703 B2 11/2008 Jansen
7,666,341 B2 2/2010 Pearce
7,730,566 B2 6/2010 Flick et al.
2002/0061384 A1 5/2002 Yates
2004/0172766 A1 9/2004 Formenti
2005/0223667 A1 * 10/2005 McCann et al. ..... 52/403.1
2006/0194925 A1 8/2006 Pearce
2007/0246157 A1 10/2007 Mason et al.
2009/0246449 A1 10/2009 Jusiak

FOREIGN PATENT DOCUMENTS

GB 1261475 1/1972
GB 2150431 A 7/1985
KR 20-0315625 6/2003
KR 20-03802721 3/2005
KR 10-2007-0026934 3/2007
WO 88/10339 A1 12/1988
WO 91/04290 A1 4/1991
WO 92/14387 A1 9/1992
WO 96/39065 A1 12/1996
WO 97/17001 A1 5/1997

OTHER PUBLICATIONS

Walker, Benjamin M., et al., Handbook of Thermoplastic Elastomers, Second Edition, 1988, pp. 26-28, Van Nostrand Reinhold Company, Inc., New York, New York.

International Search Report and Written Opinion for International Application No. PCT/US2010/035587, Publication No. WO 2010/135542, mailed Jan. 3, 2011 (7 pages).

International Search Report and Written Opinion for International Application No. PCT/US2010/035602, Publication No. WO 2010/135550, mailed Dec. 22, 2010 (8 pages).

International Search Report and Written Opinion for International Application No. PCT/US2010/035635, Publication No. WO 2010/135565, mailed Dec. 27, 2010.

* cited by examiner

CUSHIONS COMPRISING GEL SPRINGS

CROSS-REFERENCE TO RELATED APPLICATIONS

This patent application is related to U.S. patent application Ser. No. 12/784,381 filed May 20, 2010, pending, U.S. patent application Ser. No. 12/784,247, filed May 20, 2010, pending, and U.S. patent application Ser. No. 12/784,346, filed May 20, 2012, pending.

This patent application claims priority to and benefit of U.S. Provisional Patent Application Ser. No. 60/977,300, filed Oct. 3, 2007 and U.S. Provisional Patent Application Ser. No. 60/004,460, filed Nov. 27, 2007, each of which is hereby incorporated by reference in its entirety.

BACKGROUND

The subject matter hereof relates to gel springs.

BRIEF SUMMARY

Various gel springs can be constructed for cushioning purposes, as illustrated and explained herein.

DETAILED DESCRIPTION

Gel Springs Generally

Figure 1:
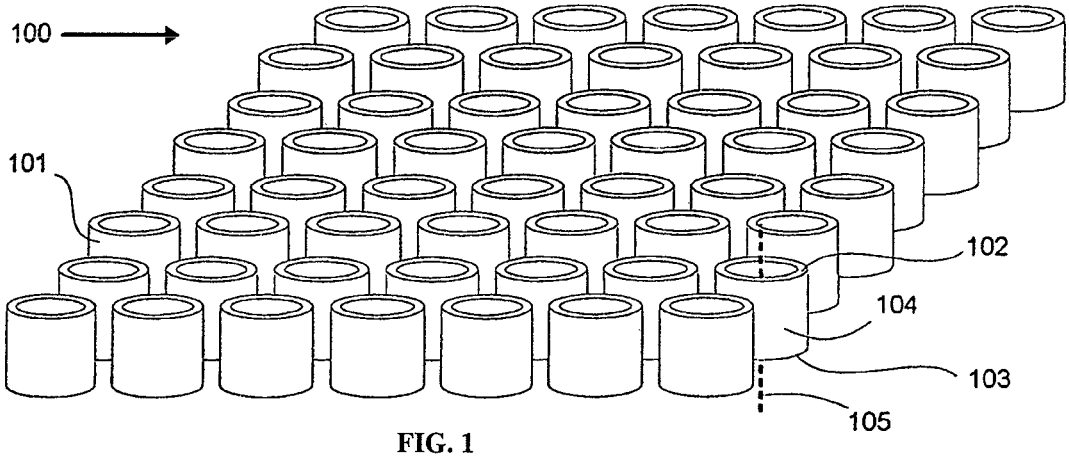
FIGS. 1, 1A, 1B, 2, 2A, 2B, 3, 3A, 3B, 4, 4A, 4B, 5, 5A, 5B, 6, 6A, 6B, 6C and 7 depict embodiments of gel springs.

Gel springs may be used in an unlimited number of cushioning applications. Gel springs are designed to buckle at a predetermined pressure threshold, and this buckling can relieve pressure hot spots and redistribute pressure so that no part of the cushioned object receives pressure above the predetermined threshold. In addition, the ability of individual gel springs to deform laterally to the direction of the principal cushioning load can relieve shear stresses. Further, the nature of most elastomers and especially plasticized elastomers such as gel is to absorb shock and attenuate vibration. When combined with the shock absorption and vibration attenuation that is supplied by the buckling action, gel springs are excellent at absorbing shock and attenuating vibration. Any cushioning application needing any or all of these characteristics will benefit by utilizing gel springs.

Gel Material

The gel springs described herein may be made in whole or in part from a gel, or other desired material. The term "gel," may refer to an elastomeric gel such as a solid elastomer extended by at least 20 parts plasticizer per 100 parts solid elastomer by weight (20:100). The elastomer could be a styrene-ethylene-ethylene-propylene-styrene (SEEPS), or styrene-ethylene-butylene-styrene (SEBS), or styrene-ethylene-propylene-styrene (SEPS) elastomer, or other elastomer, as desired. In some instances, the solid elastomer is extended to at least 50:100 and most preferably by at least 100:100. Some acceptable gels are disclosed in U.S. Pat. Nos. 7,060,213; 7,076,822; 6,908,662; 6,865,759; 6,797,765; 6,498,198; 6,413,458; 6,187,837; 6,026,527; 5,994,450, each of which is hereby incorporated by reference in its entirety.

A useful gel is KRATON® E1830 elastomer made by Kraton Polymers, Inc., of Houston, Tex., extended by white food grade mineral oil such as CARNATION® oil. Another useful gel is SEPTON® 4055 elastomer made by Septon USA and Kuraray America, Inc., extended by CARNATION® oil or other white food grade mineral oil. Other useful gels include polyurethane-based gels, silicone-based gels, PVC-based gels, acrylic-based gels, and many others.

The products and processes described herein can also utilize non-gel elastomers in place of the gel elastomers described, but in many cases the product is described as including gel by way of example and for simplicity, but not by way of limitation of the bounds of the invention. The inventors have discovered that the optional addition of hollow microspheres not only lightens the gel and reduces cost, but also can aid the manufacturing process by changing the characteristics of the gel in the melted or liquid phase. In addition, the inventors have discovered that foaming the gel (open cell or closed cell foam) can also be advantageous in reducing weight and/or material cost.

A preferred material is elastomeric gel, which may be defined as an elastomer material with at least 15% by weight plasticizer. Gel is the preferred material because it has the "feel" that is desired in many cushions such as mattresses, seat cushions, shoe insoles, and the like. Gel is able to buckle with more agility than stiffer elastomers, sometimes forming multiple curves during buckling where a stiffer elastomer may simply fold and thus not give a gradual buckling "failure," or refusing to buckle at typical cushioning pressures when manufactured at reasonable wall thicknesses. Gel, especially gel with sufficient elastomer, also provides cushioning without buckling, due to its ability to flow to shape around a cushioned object. If the cushioned object "bottoms out," or when gel is used, the resultant pressure peak on the cushioned object will be less than when bottoming out on harder elastomer. Nonetheless, although the word "gel" is used in the naming of the present invention because it is preferred in many cushioning applications, the invention applies to non-gel elastomers and/or higher-durometer elastomers, such as cross-linked latex rubber, cross-linked and non-cross-linked synthetic elastomers of many types (SANTOPRENE® of any grade, KRATON® of any grade, SEPTON® of any grade, isoprene, butadiene, silicone rubber, thermoset or thermoplastic polyurethane and many others), natural rubber, thermoplastic elastomer, PVC, synthetic rubber, polyurethane, polyurethane film, polyurethane foam, polyurethane memory foam, foamed gel, latex rubber, synthetic latex rubber, latex foam rubber, latex foam, polyolefin, foamed polyolefin (including, but not limited to, foamed polyethylene), or any other flexible or elastic material. For simplicity, the elastomer will be referred to as "gel" hereafter.

There are numerous types of gels that would work as the material from which the embodiment of the present invention is made, including silicone/plasticizer gels, polyurethane/plasticizer gels, acrylic/plasticizer gels, plasticized block copolymer elastomer gels, and others. The inventors prefer certain types of plasticized block copolymer gels, because they are less tacky, bleed or wick out less plasticizer, have greater tensile, compression, shear and tear strengths, and do not exhibit permanent deformation after being stressed repeatedly or applied long term in typical human cushioning situations. The two most preferred gels for most applications of gel springs are:

(a) SEPTON® 4055, a high Mw SEEPS tri-block copolymer elastomer (styrene-ethylene-ethylene-propylene-styrene), is melt blended with white paraffinic mineral oil with zero or low naphthenic content, such as CARNATION® oil.

The durometer can be adjusted to the specific configuration and application (for example, to provide the correct buckling pressure threshold for a given design) by adjusting the ratio of SEEPS to oil. The higher the ratio, the higher the durometer. A more complete description can be found in U.S. Pat. No. 5,994,450, which is incorporated hereby by reference. While non-limiting as an example, many cushions do well with this preferred gel in a ratio of between 150 and 800 parts by weight of mineral oil to 100 parts of SEPTON® 4055. Cushions such as mattresses and seat cushions can be advantageously made with this preferred gel in a ratio of between 250 and 500 parts by weight of mineral oil to 100 parts of SEPTON® 4055.

(b) KRATON® E1830, a SEBS tri-block copolymer elastomer (styrene-ethylene-butylene-styrene) in which the EB midblock has a wide range of Mw, the average being a high Mw, is melt blended with white paraffinic mineral oil with no or low naphthenic content, such as CARNATION® oil. The durometer can be adjusted to the specific configuration and application (for example, to provide the correct buckling pressure threshold for a given design) by adjusting the ratio of SEEPS to oil. The higher the ratio, the higher the durometer. A more complete description can be found in U.S. Patent Publication No. 2006/0194925, now U.S. Pat. No. 7,964,664, issued Jun. 21, 2011, which is incorporated by reference. While non-limiting as an example, many cushions do well with this preferred gel in a ratio of between 100 and 700 parts by weight of mineral oil to 100 parts of KRATON® E1830. Cushions such as mattresses and seat cushions can be advantageously made with this preferred gel in a ratio of between 150 and 450 parts by weight of mineral oil to 100 parts of KRATON® E1830.

Another preferred gel is made by taking the two preferred gels above and replacing part of the mineral oil with resin such as REGALREZ® of various varieties that are solid at the use temperature of the cushion, or replacing all of the mineral oil with resin that is liquid at the use temperature of the cushion such as REGALREZ® 1018. The ultra-viscous resin causes the resultant gel to have a slow rebound, which is preferable for some cushioning applications.

For example, if 1600 parts of REGALREZ® 1018 is used as the plasticizer with 100 parts of SEPTON® 4055, a soft, slow-rebound gel results at room temperature. REGALREZ® 1018 is a highly viscous fluid at room temperature. Alternatively, in that example formula the REGALREZ® 1018 can be replaced with a mixture of mineral oil and any of the Regalrez products that are solid (usually sold in chip form) at room temperature. Such a slow-rebound gel will have less temperature-related changes of durometer and rebound rate within the human comfort zone of temperatures than will a gel based on REGALREZ® 1018 as the sole plasticizer, which has a viscosity that is very changeable with temperature in the human comfort range.

One problem with the use of such slow-rebound resin-plasticized gels is that most formulations will result in a very tacky or even an adhesively sticky gel. So, when the members buckle and touch one another, they may stick together and not release when the cushioned object is removed. This can be corrected by coating the surface of the sticky gel with a material that sticks to the sticky gel, but is not itself sticky. Advantageous materials, given as examples and not by way of limitation, are microspheres and Rayon (i.e., velvet-type) flocking fibers. For example, microspheres stick very well to the tacky gel and do not come off, and thus the surface of the gel is rendered tack-free because the outer surface now consists of an outer surface of millions of non-tacky microspheres. As another example, tiny Rayon (i.e., velvet-type) flocking fibers stick very well to the tacky gel and do not come off, and thus the surface of the gel is rendered tack-free because the outer surface now consists of an outer surface of thousands of non-tacky short fibers. A third example is to put a thin skin of polyurethane elastomer onto the tacky gel, either by use of a thermoplastic polyurethane film, or by coating the tacky gel in an aqueous dispersion of polyurethane and allowing it to dry.

Gel springs made with slow rebound elastomers will have a different feel than gel springs made with the other preferred gels. Such slow-rebound gel springs will be very compatible, for example, with memory foams in a mattress or seat cushion, because the memory foam is also slow-rebound in nature.

Configurations of Gel Springs

Gel springs may be comprised of a plurality of individual gel members that when compressed in the intended cushioning direction will buckle, and/or when sheared in a direction transverse to the intended principal cushioning direction will allow transverse movement of the top vs. the bottom of the member. The gel members are connected to each other at two or more points, in many embodiments at two points that are the top and the bottom of the gel member. The members can be of any shape, and do not need to be of uniform cross-section (for example, the shapes may transition from a square cross section to an oval cross-section). They can be hollow or solid and the members may be made 100% from the gel or a combination of the gel and other materials. They can be bare gel members or can be coated or covered. The connecting material can be sheet form (e.g., fabric, gel film, plastic film), or laminate sheet form (e.g., fabric bonded to foam) or individual connectors or some other form. The connecting material can be fused into the gel (e.g., fabric hot-pressed onto the top of the member so that the gel melts and interlocks with the fabric), adhesively bonded to the gel, mechanically interlocked with the gel, attached to the gel by gripping, or can be additional gel that is integral with the members at the two or more connecting points (i.e., a gel "skin"). When not under load from a cushioned object, the gel members should be dimensionally stable enough to stay oriented toward the intended cushioning direction or the connecting material should cause them to stay oriented, and the connecting material should be sufficient to keep the members in the proper spacing from one another (including touching one another, if desired).

The buckling causes the load vs. deflection curve to deviate from the elastic line as shown by the non-limiting examples of FIGS. 8A, 8B, 8C, and 8D. Pressure is thus lessened under the buckling member and the load from the cushioning object that is thus not carried by the buckling member is redistributed to surrounding non-buckling members, thus tending toward equalization of pressure over the cushioned object. Overall pressure is also reduced because buckling allows the cushion to conform to the shape of the cushioned object, thus increasing the surface area of the cushioned object that is under a load. Since pressure is load divided by surface area, increasing the surface area lowers the overall average pressure.

The easy-stretch nature of the preferred gels allows the members to have the top of the member move laterally relative to the bottom of the member. Provided the connecting material at point one is not restricted from moving relative to the connecting material at point two, shear stresses are relieved by the easy movement of the top vs. the bottom of the gel member. This is an improvement over the shared column wall buckling configurations of the teachings of inventions in U.S. Pat. Nos. 5,749,111 and 6,026,527. While shared column wall buckling configurations are somewhat effective in shear relief, the shearing movements do build stress because the tops and/or bottoms of the columns cannot move independently from each other.

It takes energy to buckle and pop back up, and this energy helps absorb shocks and attenuate vibrations. It also takes energy to deform the gel in ways other than buckling, and the very nature of gels will help the cushions of embodiments of the present invention absorb shocks and attenuate vibrations. Thus, the gel springs embodiments of the present invention are excellent for one, two, or even all three of the desirable cushioning attributes of (1) pressure equalization and/or redistribution, (2) shear relief, and (3) shock absorption/vibration attenuation. In addition, the gel springs cushions can provide (4) support and (5) alignment. For example, in a mattress, the gel members under the most protruding body parts (e.g., hips and shoulders) can buckle, while the gel members under the least protruding body parts hold firm without buckling (e.g., the pressure buckling threshold has not been reached). The torso is supported, while the back stays aligned (all while eliminating pressure hot spots). If the hips and shoulders were not allowed to sink in, and the torso was not supported, the torso/spine would have to bend to fully reach the mattress. Thus, unlike mattresses such as firm innerspring mattresses, a mattress comprising gel springs can have no excessive pressure points and can keep the spine aligned during sleep. The result can be less tossing and turning, and less likelihood of back or neck pain.

Gel springs can be lighter weight (and thus lower cost) than the shared columns disclosed in U.S. Pat. Nos. 5,749,111 and 6,026,527 because the members are not all joined. There are practical limits to the manufacturable wall thickness of gels in a given height and durometer and configuration. Being able to space the gel members apart without a heavy gel connection that runs the whole length of the member can result in a lighter overall structure with the same overall cushioning stiffness.

Gel springs can also be lighter weight (and thus lower cost) in many embodiments than the invention described in U.S. Pat. No. 6,865,759, which has gel buckling members that are attached to a common base. In particular, the gel buckling members of '759 patent are not lightweight when a tall cushion is desired for a cushioned object that has protruding parts. Tall cushions are desirable so that the protruding parts can fully sink in before bottoming out, such that the non-protruding parts can put pressure on the members before the protruding parts bottom out, thus equalizing pressure. While the members of the disclosure of the '759 patent are tall enough to accommodate many such cushioned objects, they are not stable enough to buckle along the length of the member and just "lay over," not providing any support or buckling-cushioning. The connecting of the members at two spaced apart points along the member increases the stability and requires the members to properly buckle along the length and not just fold over at the bottom. In the '759 patent, the instability can be overcome in a small measure by making the members more massive, but this adds significantly to weight and cost and is not able to prevent the laying over in all design situations.

An example of gel springs is shown in FIG. 1. A plurality of hollow members 100 with a uniform cylindrical cross section are arranged at uniform spacing. Each member 101 has a top 102, a bottom 103, a side wall 104, and an intended cushioning direction 105. Not all members have a uniform axis such as is represented by the dashed line of the intended cushioning direction 105, but all cushions should be designed with the direction that the cushioned object will approach in mind. Some cushions need to have objects cushioned from any of several directions (for example, a number of differing degrees away from the principal cushioning direction, such as 10 degrees away, 20 degrees away, and 30 degrees away), and the shape of the member 101 should be designed to be stable enough to accommodate all such expected directions, if possible. However, in many cushions it is generally known that the intended cushioning direction will be the principle principal cushioning direction, or nearly so. For example, a person sitting on a flat horizontal seat cushion, or laying on a flat horizontal mattress, or standing on a relatively flat horizontal shoe interior, will have gravity driving the cushioned object (a person) orthogonally to the flat overall cushion surface. If for example the gel springs of FIG. 1 is to be part of a seat cushion (which will be assumed hereafter only for purposes of easy discussion), the axis of the members 101 should be orthogonal to the seat cushion surface to ensure that buckling occurs.

The design of the cushion to be able to buckle only under the higher pressure points (usually the most protruding areas) and be supported by the other areas without buckling is an interplay of all the variables: The spacing of the cylinders, the stiffness of the gel, the diameter of the cylinders, the height of the cylinders, the wall thickness of the cylinders, the durometer of the gel from which the cylinders are made, the expected weight of the person to sit on the cushion, the expected surface area of the person to contact the cushion, the degree to which the connecting material effects the behavior of the cylinders, etc. Generally test data and experience will dictate the dimensional variables, and then the formula of the gel is varied experimentally to optimize the buckling and support features.

Figure 1A:
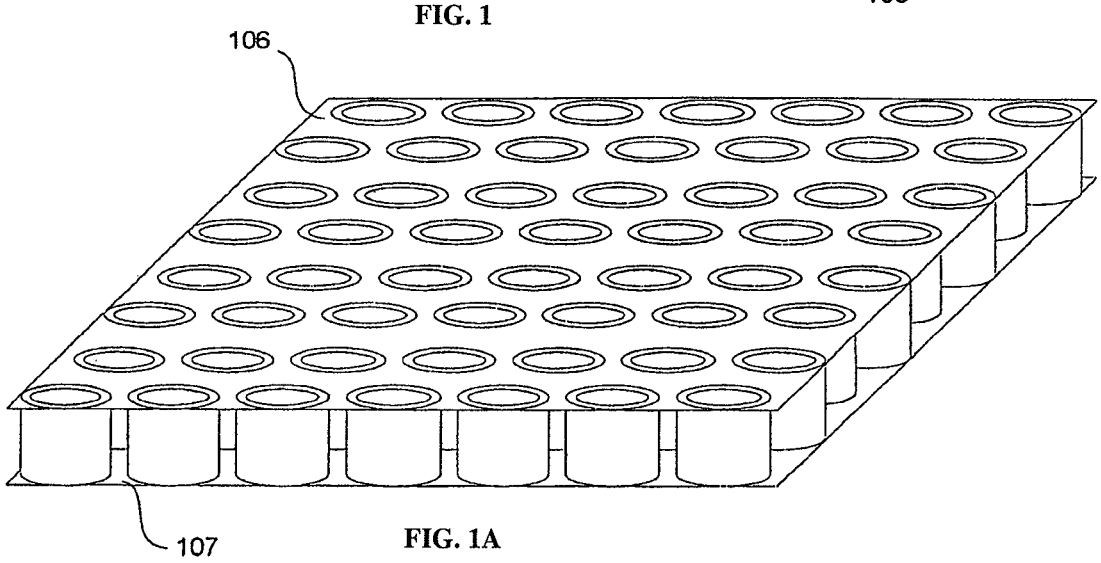
Figure 1B:
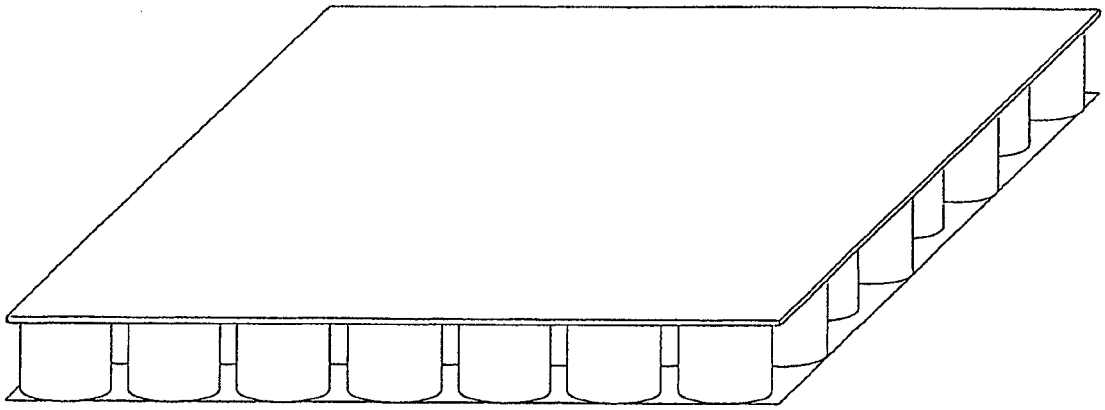

The connecting material 106 that connects the first of two points along the length of the cylindrical members (the top in this case) can be many different materials. For example, it can be a gel skin (FIG. 1B) that is integrally formed with the cylinders, either during manufacture of the cylinders, or later by melt fusing additional gel. As another example, it can be a stretchable or non-stretchable fabric that is heat-pressed into the top of the cylinders, causing the gel at the top of the cylinders to melt into the fibers of the fabric and fuse into the fabric. FIG. 1A shows the gel melted through a fabric and visible from a top of the fabric. If the fabric at the top or bottom is exceptionally easy to stretch, which is highly desirable in many cases including mattresses, then it can be further laminated (by gluing, for example) to a more stable material such as foam (e.g., conventional polyurethane foam, memory polyurethane foam, latex foam, polyethylene foam) or such as a mattress innerspring unit. As another example, the gel of the top of the cylinders can be heat fused or bonded directly to foam. The connecting material does not need to be a solid sheet as shown. It can be, for example, connecting gel beams, or a perforated sheet of gel, or connecting rigid or semi-rigid material beams. The connecting material must fulfill its function of keeping the cylinders properly spaced apart and/or oriented to the principal cushioning direction, particularly when "at rest" (the cushioned object is not in contact with the cushion). In the case of fabric, this is especially preferred because the preferred gels are difficult to bond by adhesives to foam, and it is difficult to fuse the gel into thick foams. Fabric is easily heat-fused into the gel, and fabric is also easily adhesively bondable to foam, so it is an excellent interface layer. When used as an interface layer, the material to which it is interfaced is considered part of the connection system during design, since the stiffness of all of the materials connected to the gel directly or indirectly affects the gel cylinders during cushioning. Fabrics useful include stretchable fabrics (such as LYCRA®/spandex-type fabrics, cotton tricot, nylon tricot and circular-knitted fabrics including thick circular knits such as are used for mattress tickings), and non-stretchable fabrics (such as non-woven nylon or polypropylene, or woven cotton, nylon, or polypropylene). The fabrics should have sufficient air space or at least surface roughness to allow the gel to melt and flow into the fabrics (preferred) or into the crevices on the outside of the textured fabric, unless the fabrics are joined to the members by some other method than heat fusing.

The connecting material 107 is in the FIG. 1A embodiment at the bottom of the cylindrical members. It can be any of the materials described above for the connecting material 106. The connecting material 107 does not need to be at the top and bottom of the member. For example, the members can be melt formed through a porous fabric that is 20% down from the tops of the cylinders, or 50% down from the tops of the cylinders, or 70% down from the tops of the cylinders. Beams can be bonded to the sides at any point along the length, or can be caused to grip onto the gel at any point along the length. The cylinders are shown as uniform height, but can be of varying heights. This is especially desirable in cushions where a contour is effective, such as in wheelchair cushions. The connecting material 107 is all shown at a common place on each cylinder, but this can also be varied to be at differing percent heights from column to column.

Figure 2:
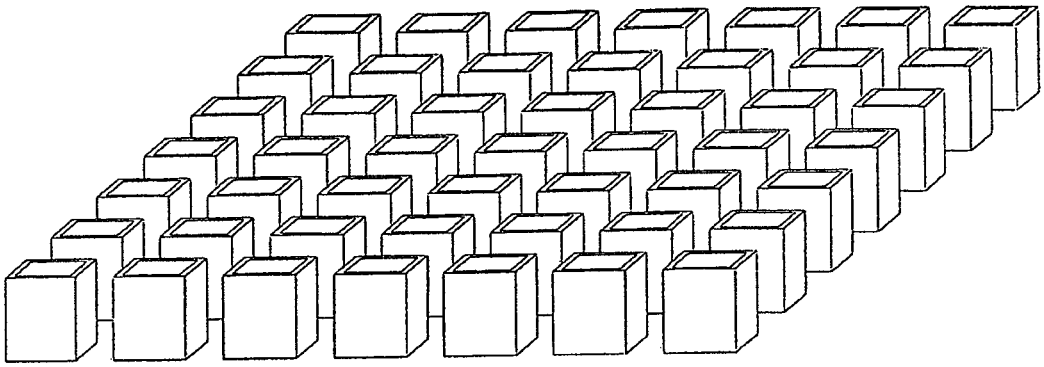
Figure 2A:
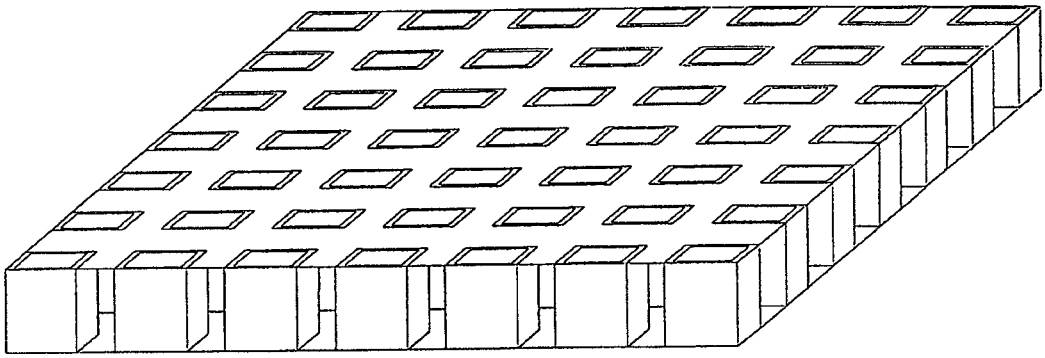
Figure 2B:
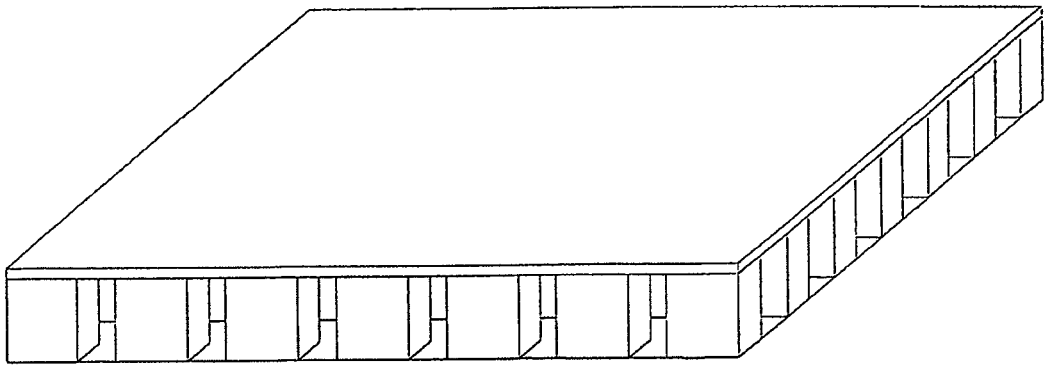

FIG. 2 shows an embodiment with hollow tubes of a square cross-section. FIG. 2A shows a fabric connecting material top and bottom, with the gel showing through the fabric after heat-fusing. FIG. 2B shows an integral gel skin at the top of the members, and a fused fabric at the bottom of the members.

Figure 3:
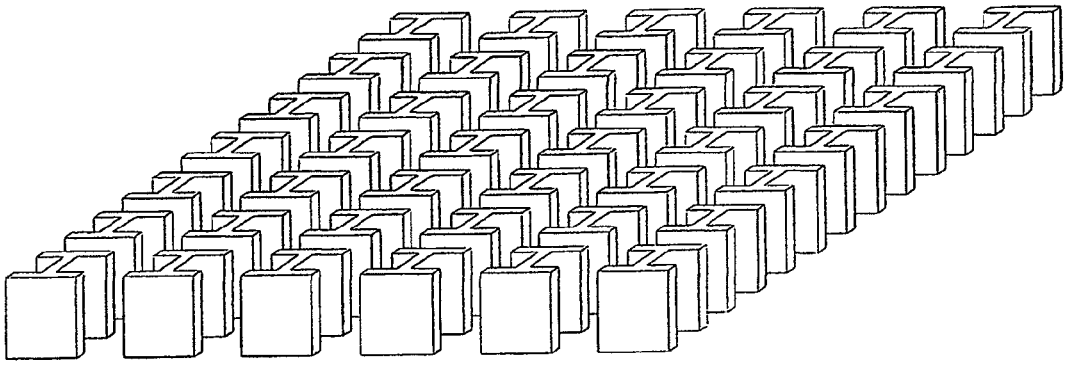
Figure 3A:
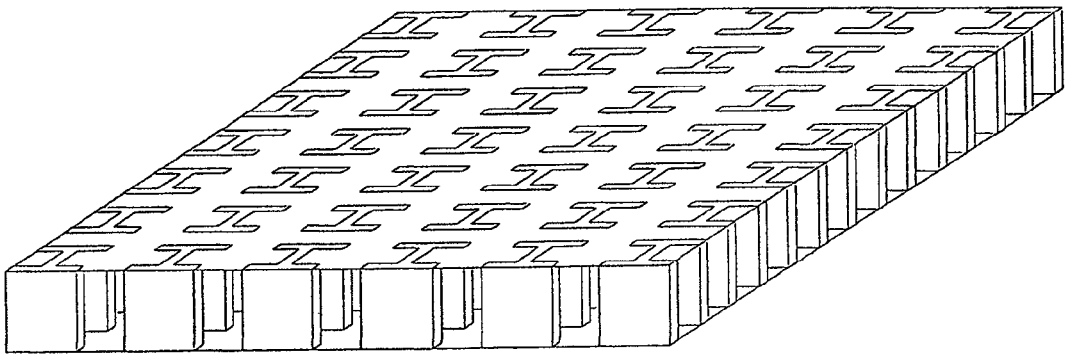
Figure 3B:
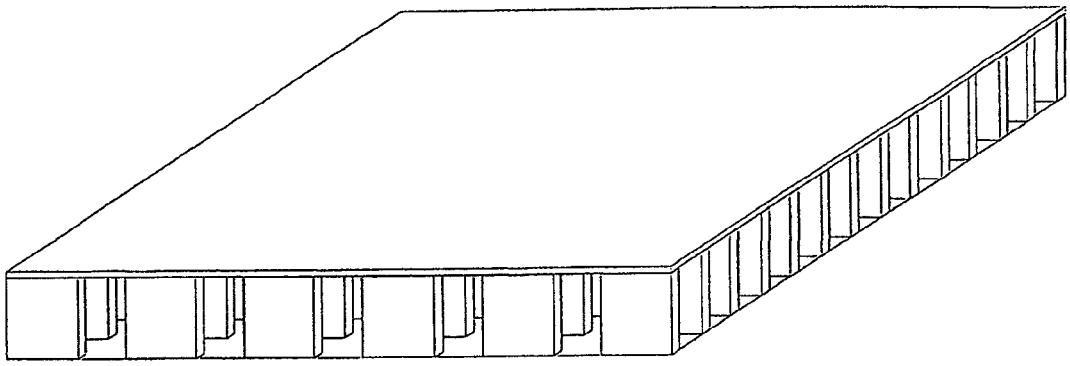

FIG. 3 shows an embodiment with solid members of an I-beam cross-section. FIG. 3A shows a fabric connecting material top and bottom, with the gel showing through the fabric after heat-fusing. FIG. 3B shows an integral gel skin at the top of the members, and a fused fabric at the bottom.

Figure 4:
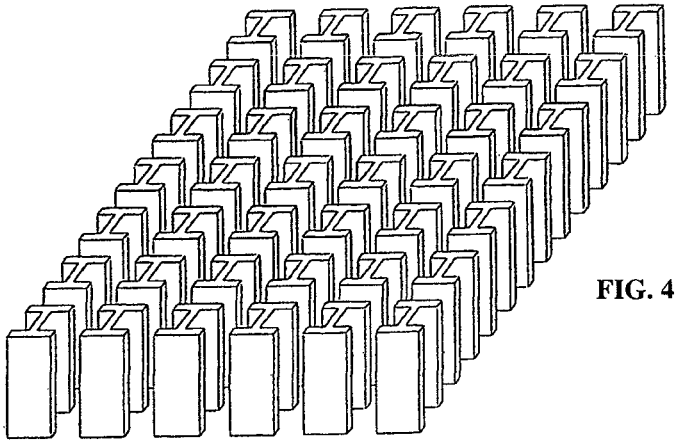
Figure 4A:
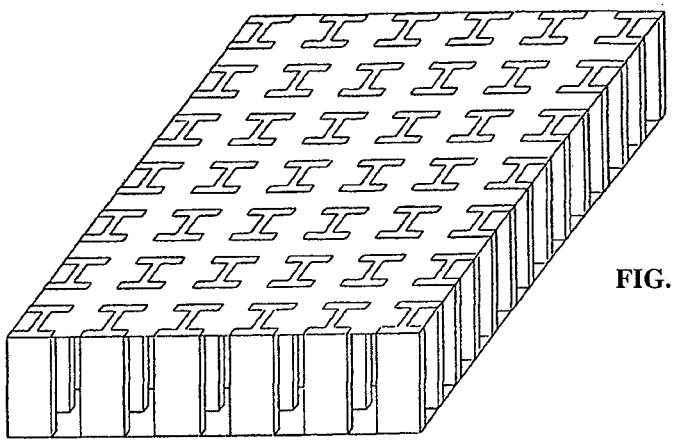
Figure 4B:
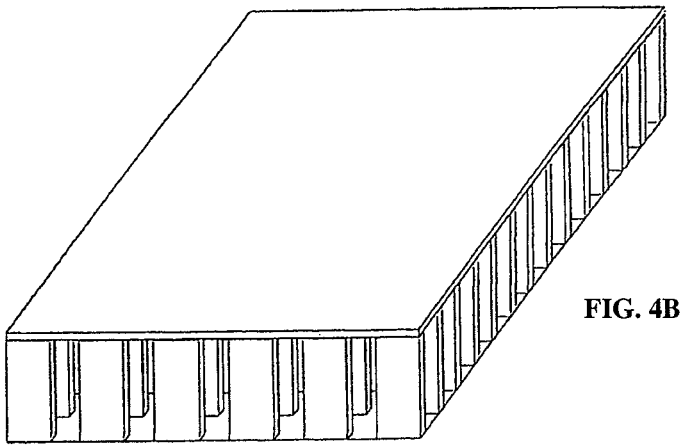

FIG. 4 shows an embodiment similar to FIG. 3, but with taller members. If the members had no connecting material as shown in FIG. 4A or 4B, they may be unstable and lay over at the bases of the members instead of buckling along the lengths of the members. FIG. 4A shows a fabric connecting material top and bottom, with the gel showing through the fabric after heat-fusing. FIG. 4B shows an integral gel skin at the top of the members, and a fused fabric at the bottom.

Figure 5:
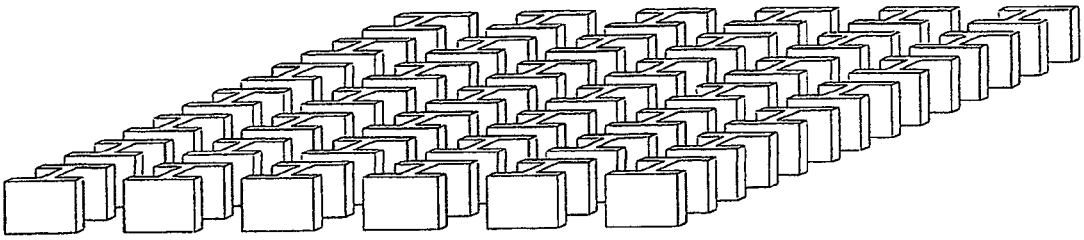
Figure 5A:
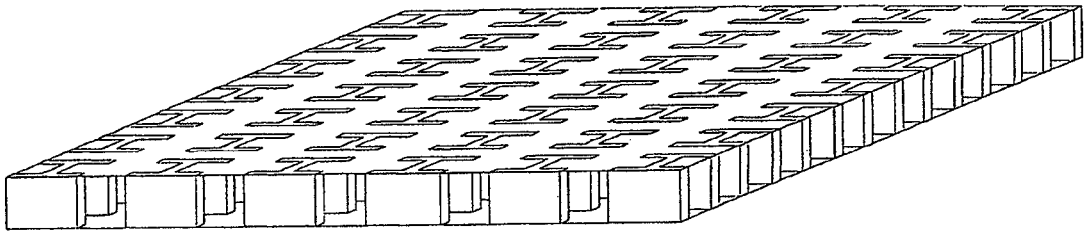
Figure 5B:
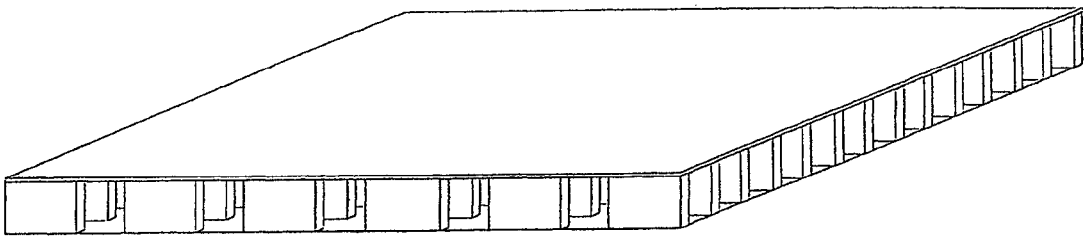

FIG. 5 shows an embodiment similar to FIG. 3, but with shorter members. Shortening the gel members but keeping all other design features the same would result in a higher buckling pressure threshold, useful for heavier people or objects or for people or objects that have a smaller surface area to be cushioned (such as the foot of a standing person compared to the body of a supine person). FIG. 5A shows a fabric connecting material top and bottom, with the gel showing through the fabric after heat-fusing. FIG. 5B shows an integral gel skin at the top of the members, and a fused fabric at the bottom.

Figure 6:
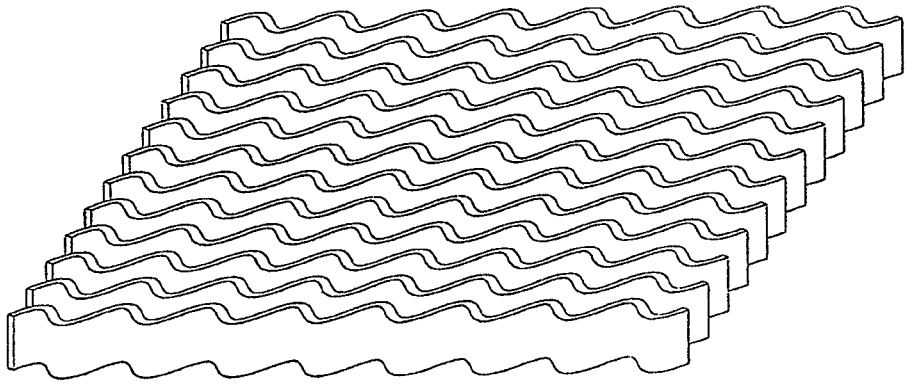
Figure 6A:
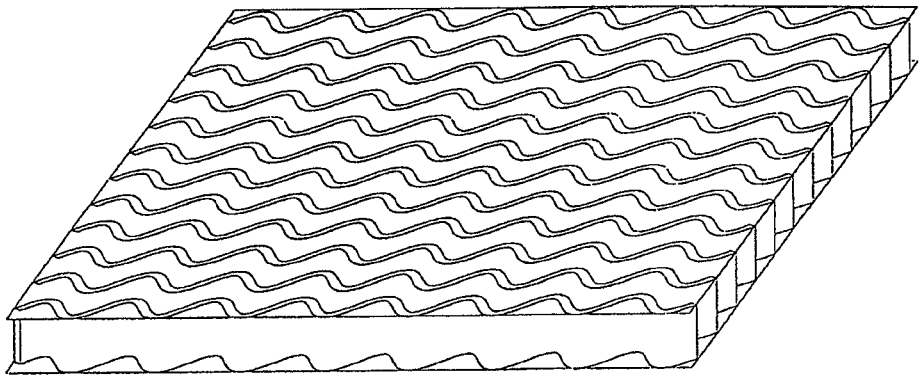
Figure 6B:
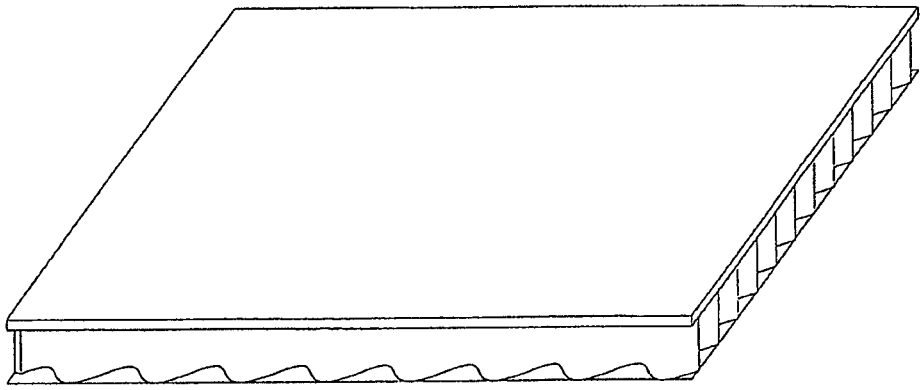
Figure 6C:
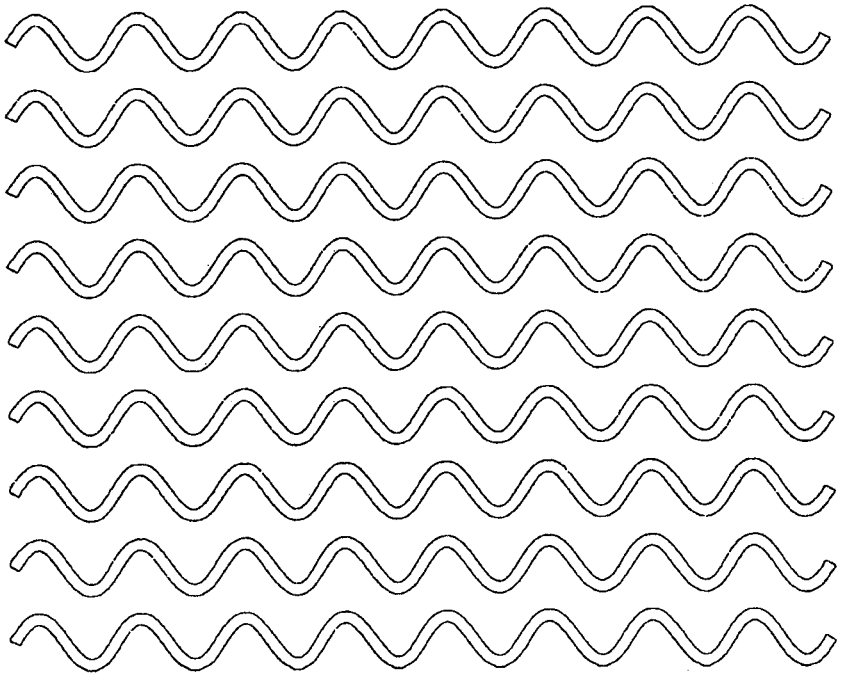

FIG. 6 shows long sine wave-shaped members. The sine wave gives each member some stability of its own. FIG. 6A shows a fabric connecting material top and bottom, with the gel showing through the fabric after heat-fusing. FIG. 6B shows an integral gel skin at the top of the members, and a fused fabric at the bottom. FIG. 6C shows a plan view of the gel members of FIG. 6 with connecting material omitted for clarity.

Figure 7:
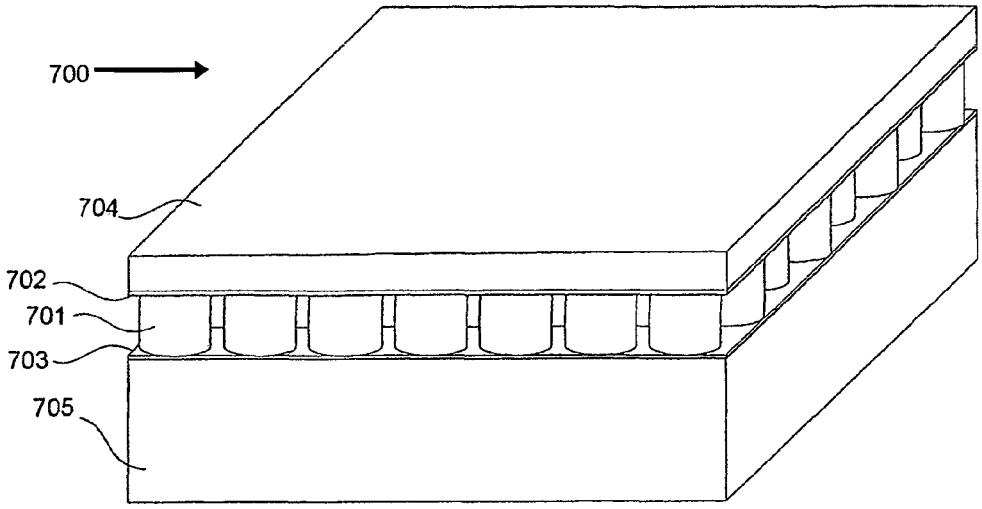
Figure 8A:
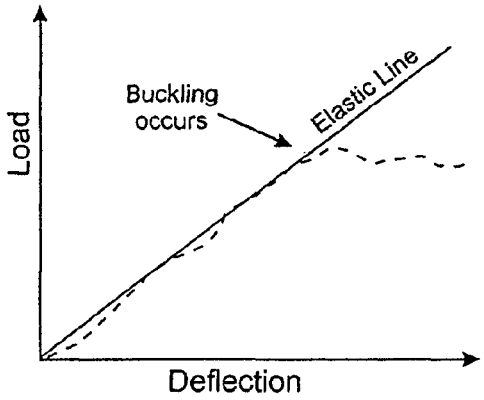
FIGS. 8A-8D depict example load versus deflection curves for gel springs.
Figure 8B:
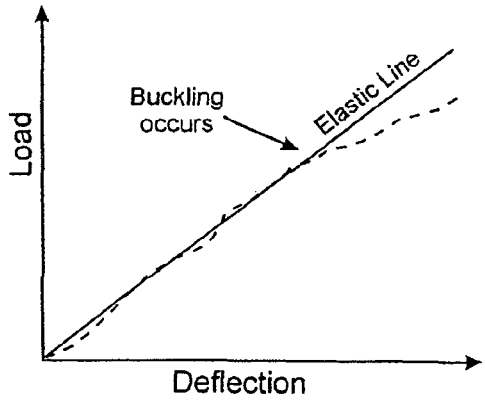
Figure 8C:
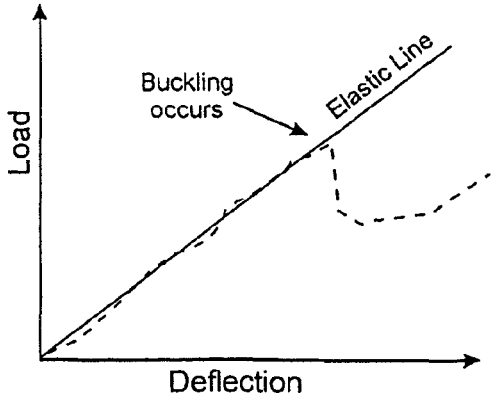
Figure 8D:
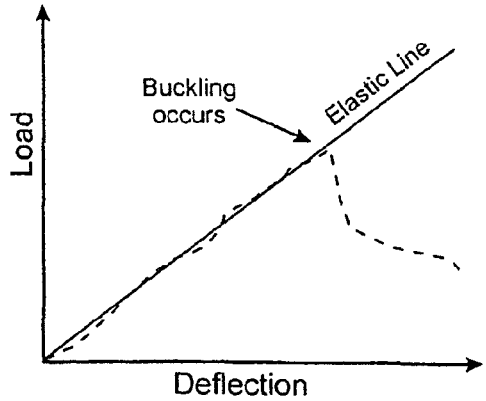

FIG. 7 shows an example configuration useful for a mattress 700. Gel springs 701 are made with 100 parts KRATON® E1830 to 300 parts CARNATION® oil white mineral oil. They are spaced 3 cm apart on an equilateral triangle pattern and fused to connector fabrics 702 and 703, a stretch knit mattress ticking fabric by Culp. Fabric 702 is bonded with water based adhesive such as SIMALFA® to latex foam rubber 704, such as latex foam rubber by Latex International. Fabric 703 is bonded with water based adhesive to polyurethane foam block 705, by Foamex (alternatively to innerspring unit 705, such as innerspring units by Leggett & Platt). The entire assembly is covered with a mattress cover (not shown).

The cross-sectional shape of the gel members at any plane cut orthogonal to the intended principal cushioning direction may be of a limitless variety of hollow shapes, for example, the cross-sectional shapes may be circular, square, rectangular, triangular, star-shaped, hexagonal, octagonal, pentagonal, oval, or irregular. The cross-sectional shape of the gel members may also be a non-hollow shape of a limitless variety of shapes, for example I-beam, H-beam, E-beam, solid circle, solid rectangle, solid square, solid triangle, solid hexagon, solid octagon, solid star, solid pentagon, solid oval, or a solid irregular shape. The members can be of uniform cross section throughout the length or the cross section can vary. For example, the members can be of varying average diameter along the length, or of varying wall thickness if hollow, or transitioning from a square shape to a circle shape, or even have varying material formulation along the length. In the same cushion, the several members can be the same as one another or different from one another. The spacing between them can be uniform or can vary. The height of each can vary. The sides of the members can be vertical or can be of another angle, and the angle can change at different places along the column length. All of these effects can create a cushion that is uniform or that is zoned, and that has a tailorable force vs. deflection curve to optimize the cushioning properties to the intended application.

Possible Gel Spring Products

By way of example only and without limitation, gel springs can be used in the following products: sleeping pads, mattresses, (medical and consumer), toppers (mattress overlays), pillows (bed, sofa, positioners, for various body parts), shoes and boots (footwear), insoles, outsoles and midsoles, sock liners (ankle cushions, cuff cushions), futons, zabutons, furniture (i.e., sofas, loveseats, recliners, ottomans, upholstered chairs, office chairs, medical chairs), theater seating, side chairs, patio and lawn furniture, stadium seats, wheelchair cushions (seat, back, arm, knee and head supports), orthopedic braces, crib mattresses, crib pads, other padding, diaper changing surfaces, pet beds, exercise benches, vehicle seats and arm rests, gymnastic pads, yoga pads, aerobic pads, sports padding, helmets, hunting pads, baby carriers, infant and child car seats, office furniture, bathtub pads, spa pads, massage tables, exam tables, carpet pads, strap cushions (such as, for backpacks, fanny packs, golf bags, purses, bras, luggage, briefcases, computer cases, after market/generic), saddle straps, straps of various kinds (such as for horses, climbing, parachutes, safety/industrial), automotive and motorcycle/ATV (seating, trim, headliners, panels), boats (seating, trim, headliners, panels), aircraft (seating, trim, headliners, panels), tool handles, appliance handles, packaging, tops of saddle seat cushions, saddle blankets, hoof pads, cushions (neck, seat, knee, between the knee, knee pads, back, lumbar), tumbling/vault pads, other athletic pads (yoga, martial arts, trampoline border pads), protective equipment (sparring, shin, shoulder, wrist, ankle, knee, elbow, hip, neck, kidney, helmets, gloves), medical positioners (surgical positioners, medical positioning cushions, orthotics, braces, slings), pads for casts for broken bones and other immobilization purposes, floor cushion for standing, bicycle gear (seat cushions, handle bars, gloves, saddles, shorts), martial arts mannequins, computer accessories (mouse pads, keyboard/wrist pads), protective bags and cases for computers, cameras, and other equipment, livestock pads (barns and trailers), pet beds, shock absorption, vibration attenuation, gurneys, stretchers, hammocks, toys, baby products (highchairs, cribs, carriers, car seats, teething items, strollers, bassinets), tree collars, any automotive, boating or recreational vehicle cushions or padding, shipping containers for fragile products, all bedding, furniture and footwear products, infant goods that contact the infant, any medical products that contact the human body, and sporting goods of all types, and any other products requiring cushioning characteristics including, without limitation, pressure relief, shock absorption or vibration attenuation.

Gel Spring Manufacturing Methods

The process for making gel springs can be any process that results in any of the specified configuration varieties made with any of the specified material options. The following are thus only examples:

Injection Molding

Because the preferred gels are thermoplastic in nature, they lend themselves well to injection molding. A mold is made by means known in the art with cavities that are filled by a standard injection molding process. The material is cooled, the mold is opened, and the part is ejected from or pulled out of the mold. Often with the preferred gels, they are so low in durometer and have such excellent conforming properties that the gel forms to the ejector pins as the pins are thrust into the mold cavity, so that the part does not eject. Thus, many times injection molds are not designed with ejector pins, but are designed to have the operator manually pull out the gel product. One advantage to injection molding with the preferred gels is that when pulled, the Poisson's effect dramatically reduces the cross-sectional thickness, and so the gel comes out without the need for a draft angle on the cavity surfaces, and can even come out if the cavity has undercuts.

Compression Molding

Many of the gel spring material alternatives can be compression molded. For example, an extruded sheet of gel can be placed over an open-faced mold that contains cavities in which the gel members are to be formed. A TEFLON® sheet is placed over a sheet of gel and a hot press applies compressive pressure to the sheet in the direction of the cavities. The gel melts and flows under this pressure into the cavities, the heat press is removed and the mold and gel are cooled. Then the TEFLON® sheet is peeled off and the gel part is pulled by an operator or by a machine, from the mold.

Rotational Molding

The gel springs of the invention can be formed by rotational molding by methods well understood in the rotational molding. A mold is prepared that has, for example, pillars that form hollows in the hollow members. The mold is filled with gel particles (for example, made with an extruder and a pelletizing die). The mold is closed, heated, and rotated by a machine. The gel pellets melt, flow and coat the pillars and outer boundary walls of the closed mold. The mold and gel are cooled, the mold is opened, and the gel part is pulled from the mold. One advantage to rotational molding is that where an integral gel skin is desired on both the top and bottom of the members, it can be formed at the same time as the members because the molten gel coats the inside of the mold as well as the pillars within the mold.

Extrusion

One of the advantages of gel springs over the structures disclosed in U.S. Pat. Nos. 5,749,111 and 6,026,527 hereinafter referred to the '111 patent and the '527 patent, is that for very large parts, for example, mattresses for medical use or household use, the tooling and equipment can be much smaller, less complicated, and less expensive. For example, each member can be separately extruded by well-known extrusion processes (molten material is forced by a rotating screw through a die with the desired cross-sectional shape, cut of at intervals, and cooled). Then the members can be arranged in the desired pattern of the gel springs cushion, and the connecting material applied top and bottom. For example, a fabric can be heat fused into the tops of all gel members simultaneously with one stroke of an inexpensive heated platen, then the assembly turned over and another fabric heat fused into the bottoms of all gel members simultaneously by the same platen. The extrusion die to make the members is very small, since it is designed to make only one member. In comparison, the '111 patent and the '527 patent disclose large open-faced molds, an extrusion die that runs the entire width of the mattress part, and large extraction rollers to pull out the gel (and still requires the heated platen to fuse in fabric). The difference in cost between the more expensive systems of the '111 patent and the '527 patent and the extrusion system hereinabove described to make gel springs can be as much as ten-fold or more, yet they result in the same size mattress part.

Screed Molding

However, for operations where cost is not as important as other considerations (such as having an integral skin or where volume of production is such that the equipment and tooling cost is amortized over a large number of parts and thus becomes inconsequential), embodiments of the present invention may provide an open-faced pressure-screeding system to make large (or small) gel springs cushions, including by way of one example the following steps:

(a) Obtaining a screed mold, the screed mold having a rigid body, the screed mold being an open face mold, the screed mold having multiple recesses in the rigid body in which gel may be formed into members of a desired shape, the screed mold optionally having a raised lip at both the right side and left side of the mold, which allows for a sheet of gel to form at the top of the screed mold that will be integral with the gel columns, or optionally having no raised lip so that the gel is screeded by the screed head flush with the mold's top surface or later scraped to that point;

(b) Obtaining access to an injection head, the injection head having a plurality of distribution channels therein through which molten gel may flow, the plurality of distribution channels optionally being subdivided into sub-distribution channels, the distribution channels or sub-distribution channels terminating in exit ports through which molten gel may exit the injection head and enter the screed mold, the injection head including at least one external or internal heating means for heating the injection head;

(c) Positioning the injection head adjacent the screed mold in a location so that molten gel may flow from the injection head distribution channels out of the exit ports and into the screed mold member-forming recesses and (if a gel skin is desired) into a skin-forming recess;

(d) Accessing a pumping source, utilizing the pumping source to pressurize molten gel and force it into the injection head, through the plurality of distribution channels of the injection head, out of the exit ports of the injection head, into the screed mold, in most cases while the screed mold is moving relative to the injection head, so that the injection head screeds off the top of the molten gel as uniformly as practical and fills the screed mold in a progressive manner;

(e) Cooling the gel so that it is no longer molten;

(f) Recovering molded gel material from the screed mold in a desired geometric shape of a gel spring cushioning element.

Figure 9:
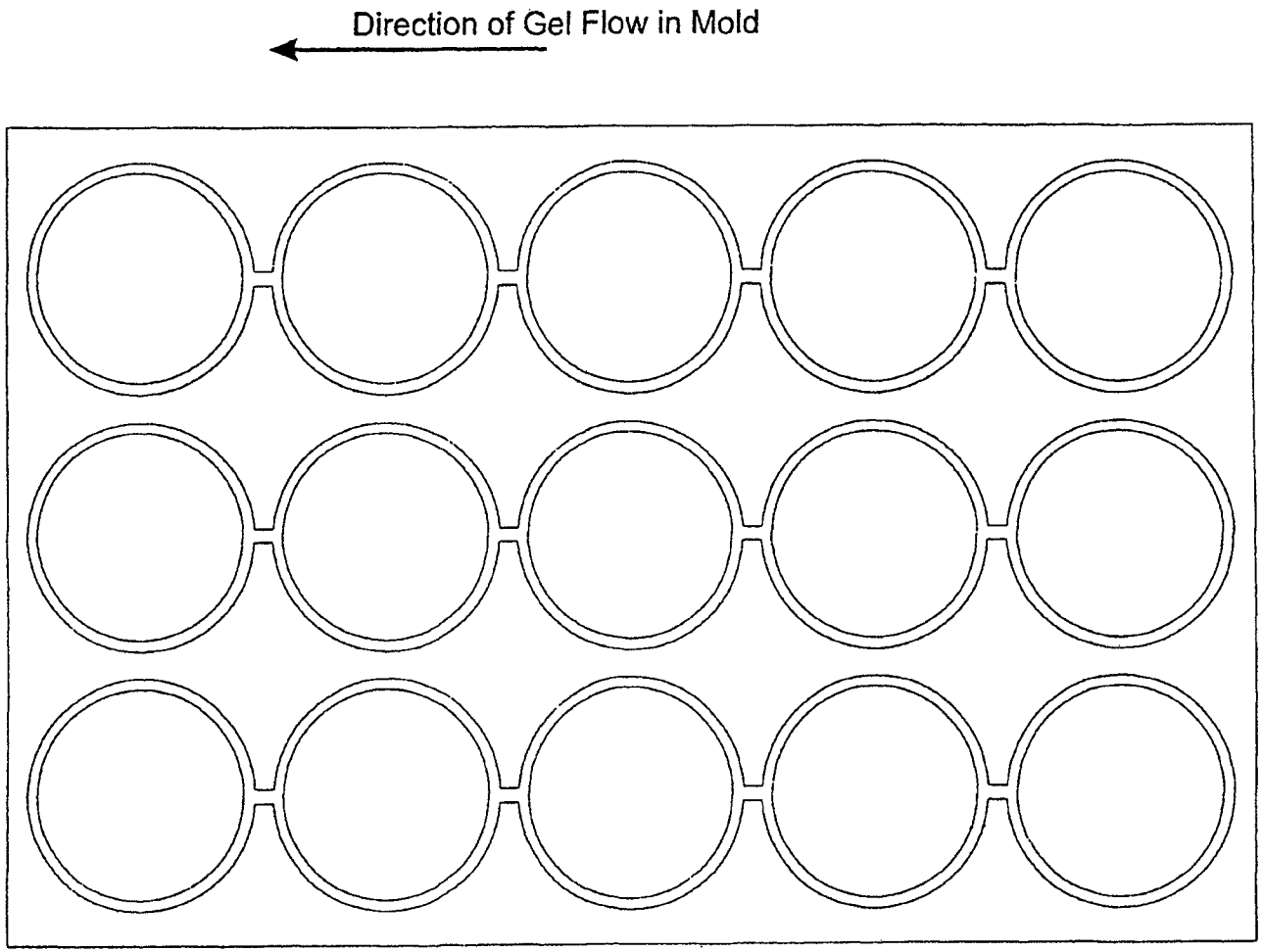
FIG. 9 depicts an embodiment of a screed molding process.

FIG. 9 depicts an open-face mold for use in one example of a screed molding process. Molten gel can be placed into the open-face mold and permitted to harden, with gel springs then being taken out of the mold. Individual strings of gel springs in a tubular form may be removed from the mold and held together by a connecting membrane. This allows the whole string of gel spring tubes to be pulled out of the mold as a set without having to get a grip on each tube. This permits implementation of a continuous molding process where the mold edges come together to make the joint continuous. Referring to the drawing of FIG. 9, the gel springs can be as tall as the cavities are deep. Further information concerning screed molding is found in United States Patent Publication No. 2005/0173836, now U.S. Pat. No. 7,666,341, issued Feb. 23, 2010, which is hereby incorporated herein by reference in its entirety. However, the configuration of the mold may be such that gel springs are produced as described herein.

An integral skin on a gel spring product is preferred because it allows a lifting out from the mold all of the members at once, since they are all connected. Additionally, the integral skin keeps the members properly positioned relative to one another. However, if no integral skin is desired as a connecting material (for example, for weight/cost savings or breathability), the screed mold side lips are omitted and the screed mold is automatically or manually scraped off right at the top of each column during molding. Then, to avoid the necessity of removing each member individually, optionally, a fabric could be pressed into the molten gel or with heat sufficient to re-melt the tops of the members if no longer molten, then the members cooled and the assembly of the fabric with fused-in gel members pulled out of the mold.

Often, but not necessarily, a fabric is fused into the tops and/or bottoms of the columns, which facilitates gluing the assembly to other elements of the cushion, such as foam, springs, or the mattress cover. If an integral gel skin is formed as one of the connecting materials, a fabric can be fused onto the other end of the members. A preferred process for fusing fabric into the ends of members of a gel spring unit is to place the members in their desired spacing and orientation and then place the fabric over the top, preferably smoothing out any wrinkles. A heated platen of a press, preferably at a temperature that will melt the gel but not burn or degrade it, may bear on the fabric. Preferably, the press will have a mechanical stop at a distance below the top of the fabric that has been determined to be optimal, usually at least half the thickness of the fabric below the top of the fabric. After a sufficient period of time that allows the gel to melt and flow into the external and/or internal interstices of the fabric, the platen is raised, the gel is allowed to cool to the point of solidification, and the assembly is removed from the press. The same can be done to the other side of the assembly, whether or not a gel skin exists on that other side. If a gel skins exists on both sides, a fabric can optionally be fused into both sides to enable gluing of the assembly to foam, or springs or other materials. An alternative is to orient separate individual gel springs between two pieces of fabric and pull the assembly through a pair of platens, which simultaneously fuses the top and bottom fabrics. This can be a continuous process in which the fabric comes in from rolls and the gel spring members are placed onto it in continuous succession.

A partial skin can be integrally formed that connects all gel spring members but still allows breathability. This is done by configuring the open-faced mold with areas, which when screeded and/or scraped, leave holes through the skin without removing the entire skin.

With any of these processes, the resulting assembly of a plurality of gel springs can be utilized as a cushion, or as a cushioning element within a cushion. The fused-fabric alternatives described herein are especially adapted to be bonded to other cushioning elements to make a composite cushion. For example, they can be easily glued to foam, or they can be glued to an insulator fabric that is bonded or fastened to an innerspring mattress unit. They can be glued to an EVA midsole in footwear. Or, they can be bonded directly to a cover. Covers can also be applied without bonding, including without limitation, by slip-over, by zipper closure, by hook-and-loop closure, or without a closure.

Example 1

An Example embodiment of a mattress is as follows: the base of the mattress is four inches of 36-ILD, 1.8-pound-density conventional polyurethane foam. Above that is bonded a layer of square cross-section individual gel springs (without integral gel skin) with fabric fused at the tops and bottoms. The square cross section is uniform and is two inches on each side. The wall thickness is one eighth of an inch. The distance between columns is three quarters of an inch. The height of each square hollow column is three and a half inches. The gel was made with Formula (b) above in a ratio of 300 parts CARNATION® oil to 100 parts KRATON® E1830, with 0.1% each of antioxidants Irgannox 1010 and Irgaphos 168 and 0.1% Horizon Blue aluminum lake pigment from the Day-Glo Corporation. The hollow columnar members were made in an extrusion die and cut to the 3.5-inch length, then placed in a jig and cotton tricot one-way stretch fabric (two ounces per yard) was heat fused to the tops. The assembly was turned over and the same type of fabric was heat-fused to the bottoms. The bottom fabric was then glued with SIMALFA® water-based adhesive (environmentally friendly as compared to solvent-based adhesives) to the 4-inch foam base. To the fabric at the top of the gel springs assembly is glued 1.5 inches of 5-lb/in$^3$-density memory-type polyurethane foam (SENSUS® brand, made by Foamex). To the other side of the memory foam is glued 1.5 inches of 18-ILD Talalay latex foam made by Latex International. The entire assembly is then covered in a circular-knitted fire retardant sock and then a mattress cover is applied by conventional means.

Example 2

An Example embodiment of a wheelchair cushion, consumer seat cushion or truck driver seat cushion is as follows: A rotational mold is made, with overall interior cavity size of 16 inches×16 inches×3.5 inches. Posts are placed in the mold that extends from the top 16 inches×16 inches side to the bottom 16 inches×16 inches side, at 1.5-inch intervals. The posts are 0.6 inch in diameter and of circular cross section. Under the area where the person's ischial tuberosities will be placed, the spacing is increased to 2-inch intervals. Each post is in two parts. The top half of each post is affixed to the top of the mold, the bottom half of each post is affixed to the bottom of the mold, so that when the mold is closed the two halves make one post. A gel is made of 250 parts DUOPRIME® 90 mineral oil and 100 parts by weight SEPTON® 4055, with 0.1% each of antioxidants Irgannox 1010 and Irgaphos 168 and 0.2% Rocket Red aluminum lake pigment from the Day-Glo Corporation. The gel is melt blended in an extruder and pelletized. The pellets are put into the rotational mold sufficient to provide a skin around the periphery of the cavity and on the posts of about 0.1-inch thick. The mold is closed, heated, and rotated to allow the molten gel to coat all surfaces. The mold is cooled by spraying water on the exterior while continuing to rotate the mold. The mold is opened and the post-halves slip out of the gel on their respective sides, and the part is removed. Air holes are cut into the skin so that when the cushion is compressed, air is not trapped. The cushion may be used as is or a cover may be applied.

Example 3

An Example embodiment of a "sock insert" or "insole" gel springs cushion for use in a shoe is as follows: An injection mold is made, wherein a cavity is configured to mold a plurality of hollow gel circular columns integrally connected by a bottom skin. The bottom skin is 0.1-inch thick. The columns are hollow and have a constant inner diameter ID of 0.15 inch. The wall thickness varies from 0.05 inch at the top to 0.15 inch at the bottom where they join the bottom skin. The gel utilized in Example 3 is the same as described in Example 1. The gel springs cushion is molded by standard injection molding methods, with the following uniqueness: The side of the mold with the pins that form the cavities in the gel columns has a one-way stretch low-friction fabric placed against it before molding. The fabric is hole-punched with holes that fit over the pins. The mold is closed and the material is shot and cooled. When removed from the mold, the fabric connecting material is already fused into the tops of the conical cylinders. The fabric, which is only gel infused over a small percentage of its surface, provides a more effective "slip surface" for the socks of a user than does a full-gel surface, in addition to functioning as a connecting layer as described herein. Alternatively, another layer of fabric can be bonded onto the gel springs cushion (or heat-fused so that the gel does not penetrate the full thickness of the fabric) and so that gel friction does not interfere with "sock sliding." Alternatively, the fabric can be a laminate such that the gel can penetrate only the bottom layer of the laminate and the top layer is slippery.

While embodiments of the present invention have been described and illustrated in conjunction with a number of specific embodiments, those skilled in the art will appreciate that variations and modifications may be made without departing from the principles of embodiments of the invention as herein illustrated, described, and claimed. Embodiments of the present invention may be embodied in other specific forms without departing from its spirit or essential characteristics. The described embodiments are to be considered in all respects as only illustrative, and not restrictive. All changes that come within the meaning and range of equivalency of the claims are to be embraced within their scope.

What is claimed is:

1. A gel springs cushion comprising:

a plurality of individual gel spring members, each gel spring member having a top surface, a bottom surface, and a side wall, each gel spring member being bucklable in a loading direction generally parallel to the side wall, wherein the top surface may move laterally relative to the bottom surface;

a layer of non-stretchable material bonded directly to the bottom surface of each individual gel spring member; and a layer of stretchable material bonded directly to the top surface of each individual gel spring member;

wherein the side wall of each gel spring member is unsupported between the layer of non-stretchable material and the layer of stretchable material.

2. The gel springs cushion of claim 1, wherein the layer of stretchable material comprises a first fabric.

3. The gel springs cushion of claim 2, wherein the layer of non-stretchable material comprises a second fabric.

4. The gel springs cushion of claim 3, wherein at least a portion of material of the plurality of individual gel spring members is disposed within at least one of the first fabric and the second fabric.

5. The gel springs cushion of claim 3, further comprising a foam material bonded to the first fabric or the second fabric.

6. The gel springs cushion of claim 3, further comprising an innerspring assembly secured to the first fabric or the second fabric.

7. The gel springs cushion of claim 3, wherein each gel spring member of the plurality is heat-fused to the first fabric and the second fabric.

8. The gel springs cushion of claim 1, wherein at least one of the non-stretchable material and stretchable material comprises a sheet of gel.

9. The gel springs cushion of claim 1, wherein a first cross section of at least one gel spring member of the plurality is different from a second cross section of the at least one gel spring member of the plurality, the first and second cross sections taken transverse to the sidewall.

10. The gel springs cushion of claim 1, wherein at least one gel spring member of the plurality is hollow.

11. The gel springs cushion of claim 1, wherein at least one gel spring member of the plurality is solid.

12. The gel springs cushion of claim 1, wherein at least one gel spring member of the plurality comprises a slow rebound gel that includes a material selected from the group consisting of resin and rosin.

13. The gel springs cushion of claim 1, wherein buckling of at least one gel spring member of the plurality causes a deviation from the elastic line in a plot of load as a function of deflection for the at least one buckled gel spring member.

14. The gel springs cushion of claim 1, wherein at least one gel spring member of the plurality is at least partially constructed from an elastomeric gel.

15. The gel springs cushion of claim 1, wherein the side walls of each gel spring member are generally parallel;

the top surfaces of each gel spring member are within a common top plane; and the bottom surfaces of each gel spring member are within a common bottom plane.

16. The gel springs cushion of claim 1, wherein at least one gel spring member of the plurality is hollow and at least one gel spring member of the plurality is solid.

17. The gel springs cushion of claim 1, wherein at least one gel spring member of the plurality of individual gel spring members is connected to an adjacent gel spring member of the plurality of individual gel spring members at a first end and at a second, opposing end of the at least one gel spring member.

18. A gel springs cushion comprising:

a non-stretchable first fabric;

a stretchable second fabric; and a plurality of individual gel spring members bonded directly to the first fabric and the second fabric, each individual gel spring member comprising an elastomeric gel, wherein:

at least one of the plurality of individual gel spring members is bucklable in a direction generally perpendicular to a plane of the first fabric or a plane of the second fabric; and a top surface of at least one of the plurality of individual gel spring members may move laterally relative to a bottom surface of the at least one of the plurality of individual gel spring members.

19. The gel springs cushion of claim 18, wherein at least one of the plurality of individual gel spring members is heat-fused directly to the first fabric and the second fabric.

20. The gel springs cushion of claim 18, wherein a first cross section of at least one gel spring member of the plurality is different from a second cross section of the at least one gel spring member of the plurality, the first and second cross sections taken parallel to the plane of the first fabric or the plane of the second fabric.

21. The gel springs cushion of claim 18, wherein at least one gel spring member of the plurality defines at least one hollow.

22. The gel springs cushion of claim 18, wherein at least one gel spring member of the plurality is solid.

23. The gel springs cushion of claim 18, wherein at least one gel spring member of the plurality comprises a slow rebound gel that includes a material selected from the group consisting of resin and rosin.

24. The gel springs cushion of claim 18, wherein buckling of an individual gel spring member of the plurality causes a deviation from the elastic line in a plot of load as a function of deflection for the buckled gel spring member.

25. The gel springs cushion of claim 18, wherein at least two gel springs members of the plurality are hollow and in contact with each other along their peripheries.

26. The gel springs cushion of claim 18, wherein the non-stretchable first fabric is affixed to a non-gel springs cushioning element, the non-gel springs cushioning element having a structure selected from the group consisting of foam and an innerspring assembly.

27. The gel springs cushion of claim 18, wherein at least one gel spring member of the plurality defines at least one hollow and at least one gel spring member of the plurality is solid.

* * * * *